US007320619B2

(12) United States Patent
Takahashi et al.

(10) Patent No.: US 7,320,619 B2
(45) Date of Patent: Jan. 22, 2008

(54) FIXING MEMBER AND MOUNTING STRUCTURE

(75) Inventors: Shinji Takahashi, Aichi-ken (JP); Yoshiaki Kato, Aichi-ken (JP); Harehide Sasaki, Aichi-ken (JP); Katsumasa Matsuoka, Aichi-ken (JP); Masato Minakata, Toyota (JP); Hiroshi Kobayashi, Toyota (JP)

(73) Assignee: Kabushiki Kaisha Tokai-Rika-Denki-Seisakusho, Aichi-ken (JP)

( * ) Notice: Subject to any disclaimer, the term of this patent is extended or adjusted under 35 U.S.C. 154(b) by 0 days.

(21) Appl. No.: 11/623,037

(22) Filed: Jan. 12, 2007

(65) Prior Publication Data

US 2007/0173114 A1 Jul. 26, 2007

(30) Foreign Application Priority Data

Jan. 23, 2006 (JP) ..... 2006-013922

(51) Int. Cl.
*H01R 13/66* (2006.01)

(52) U.S. Cl. ..... 439/567

(58) Field of Classification Search ..... 439/567–571
See application file for complete search history.

(56) References Cited

U.S. PATENT DOCUMENTS 4,681,389 A * 7/1987 Nakazawa et al. ..... 439/567
5,257,948 A * 11/1993 Peterson ..... 439/571
5,409,399 A * 4/1995 Geoghegan et al. ..... 439/567
5,489,219 A * 2/1996 Fabian ..... 439/567
5,868,587 A * 2/1999 Westlund ..... 439/567
5,899,771 A * 5/1999 Clark et al. ..... 439/567
5,957,722 A * 9/1999 Pan et al. ..... 439/567
5,971,803 A * 10/1999 McHugh et al. ..... 439/567
6,565,383 B1 * 5/2003 Wu ..... 439/567
6,638,105 B1 * 10/2003 Wu ..... 439/567
7,052,317 B2 * 5/2006 Hara et al. ..... 439/567
7,172,457 B1 * 2/2007 Lin ..... 439/565

FOREIGN PATENT DOCUMENTS

JP 9-330753 A 12/1997
JP 11-111407 A 4/1999

* cited by examiner

*Primary Examiner*—Briggitte R. Hammond
(74) *Attorney, Agent, or Firm*—Roberts, Mlotkowski & Hobbes; Thomas W. Cole

(57) ABSTRACT

A fixing member of the present invention can be mounted to a fixed member that is fixed to a printed circuit board, and is used for fixing the fixed member to the printed circuit board, the fixing member including: a male connector portion inserted into an insertion opening formed in the printed circuit board; a plurality of arm portions provided at the male connector portion; lug portions provided at each tip end side of the arm portions and engaged with an opening edge of the insertion opening; and a lug-guiding portion extending out from a tip end portion of at least one lug portion to guide the lug portion to the insertion opening when the lug-guiding portion comes in contact with the opening edge and is further pressed.

9 Claims, 8 Drawing Sheets

FIXING MEMBER AND MOUNTING STRUCTURE

CROSS-REFERENCE TO RELATED APPLICATIONS

This application claims priority under 35 USC 119 from Japanese patent Application No. 2006-013922, the disclosure of which is incorporated by reference herein.

BACKGROUND OF THE INVENTION

1. Field of the Invention

The present invention relates to a fixing member that can be mounted to a fixed member to be fixed to a printed circuit board and that is used for fixing the fixed member to the printed circuit board, and also relates a mounting structure.

2. Description of the Related Art

A large number of electronic components are mounted on a printed circuit board (PCB). The electronic components need to be fixed to the printed circuit board and, therefore, a fixing member to which the electronic components are attached is often fixed to the printed circuit board (for example, see Japanese Utility Model Application Publication (JP-Y) No. 5-35592, Japanese Patent Application Laid-open (JP-A) No. 2002-151191, JP-A No. 11-111407, JP-A No. 9-330753, Japanese Utility Model Application Laid-open (JP-U) No. 5-27969, and JP-A No. 2005-310626). Conventional art will be described below by way of example.

As shown in FIG. 9, conventionally, to fix an electronic component 84 to a printed circuit board 82, a fixing member 80 is mounted to the electronic component 84 and the fixing member 80 is fixed to the printed circuit board 82 by soldering.

More specifically, the fixing member 80 includes a male connector portion 88 and the male connector portion 88 comprises a plurality of arm portions 87F, 87N having lug portions 99F, 99N, which are respectively formed at the tip ends thereof and are inserted into an insertion opening 90 in the printed circuit board 82.

The lug portions 99 are engaged with an opening edge 90E when inserted into the insertion opening 90. After the male connector portion 88 is inserted into the insertion opening 90 and the lug portions 99 are engaged with the opening edge 90E, the lug portions 99 are joined to the printed circuit board 82 by soldering so as to fix the fixing member 80.

When inserting the male connector portion 88 into the insertion opening 90, the male connector portion 88 may be inserted with its arm portions 87 inclined with respect to the opening edge 90E in some cases. If an inclination angle θ with respect to a direction normal to the insertion opening 90 becomes excessively large, tip ends of the lug portions 99 come in contact with an area peripheral to the insertion opening 90 and lug portions 99 are not guided to the insertion opening 90.

SUMMARY OF THE INVENTION

The present invention has been made to solve the above-described problems, and a first aspect of the invention provides a fixing member that can be mounted to a fixed member to be fixed to a printed circuit board, and that is used for fixing the fixed member to the printed circuit board, the fixing member comprising: a male connector portion inserted into an insertion opening formed in the printed circuit board; a plurality of arm portions provided to the male connector portion; a lug portion provided at each tip portion of the arm portions and engaged with an opening edge of the insertion opening; and a lug-guiding portion extending out from a tip end portion of at least one lug portion toward the other lug portion(s) and guiding the lug portion to the insertion opening when coming in contact with the opening edge and being further pressed.

Thus, when pressing the fixed member mounted to the fixing member so as to insert the male connector portion thereof into the insertion opening in the printed circuit board, the lug-guiding portion can guide the lug portions to the insertion opening even if the inclination angle of the male connector portion with respect to the direction normal to the insertion opening is large. Accordingly, a range of acceptable inclination angles can be broadened compared with that in the conventional art. Consequently, it is possible to obtain a fixing member having lug portions of the male connector portion which can be easily inserted into the insertion opening in the printed circuit board.

A second aspect of the invention to achieve the above object provides a fixing member according to the first aspect, wherein the two arm portions are provided and the lug-guiding portion extends out from the tip end portion of the lug portion of at least one of the arm portions.

A third aspect of the invention to achieve the object provides a fixing member according to the second aspect, wherein the lug-guiding portion extend out from the tip end of the lug portion of each of the two arm portions and the lug-guiding portions are formed so as not to interfere with each other when the lug-guiding portions come in contact with the opening edge and guide the lug portions to the insertion opening.

In the fixing member according to the above aspects, bending of the arm portions is not obstructed by interference of the lug-guiding portions with each other.

A fourth aspect of the invention to achieve the above object provides a mounting structure comprising: the fixing member according to any one of first to third aspects; a fixed member on which the fixing member is mounted and from which a terminal protrudes; and a printed circuit board having an insertion opening through which a male connector portion provided on the fixing member is inserted and an insertion hole through which the terminal of the fixed member is inserted, the fixed member being mounted by inserting the male connector portion through the insertion opening and by inserting the terminal through the insertion hole.

A fifth aspect of the invention to achieve the above object provides a mounting structure according to the fourth aspect, wherein the dimensions of the lug-guiding portion in the fixing member are set so that, when the male connector portion of the fixing member is pressed toward the insertion opening in the printed circuit board in a state in which the terminal of the fixed member is inserted into the insertion hole, the lug-guiding portion comes in contact with the opening edge and the lug portion is inserted into the insertion opening.

In the mounting structure according to the above aspects, when producing the mounting structure by mounting the fixing member on which the fixed member is mounted to the printed circuit board, mounting can be carried out even by forced insertion. Therefore, the mounting operation is considerably easier and mounting operation time is considerably reduced compared with the conventional art.

A sixth aspect of the invention to achieve the above object provides a mounting structure according to the fifth aspect, wherein the dimensions of the lug-guiding portion in the fixing member are determined based on the inclination angle of the male connector portion with respect to the direction normal to the insertion opening in the printed circuit board when the terminal of the fixed member is inserted into the insertion hole and also the lug portion is in contact with the opening edge of the insertion opening.

In the above mounting structure, appropriate dimensions of the lug-guiding portion of the fixing member can be easily set.

DESCRIPTION OF THE PREFERRED EMBODIMENTS

Figure 1:
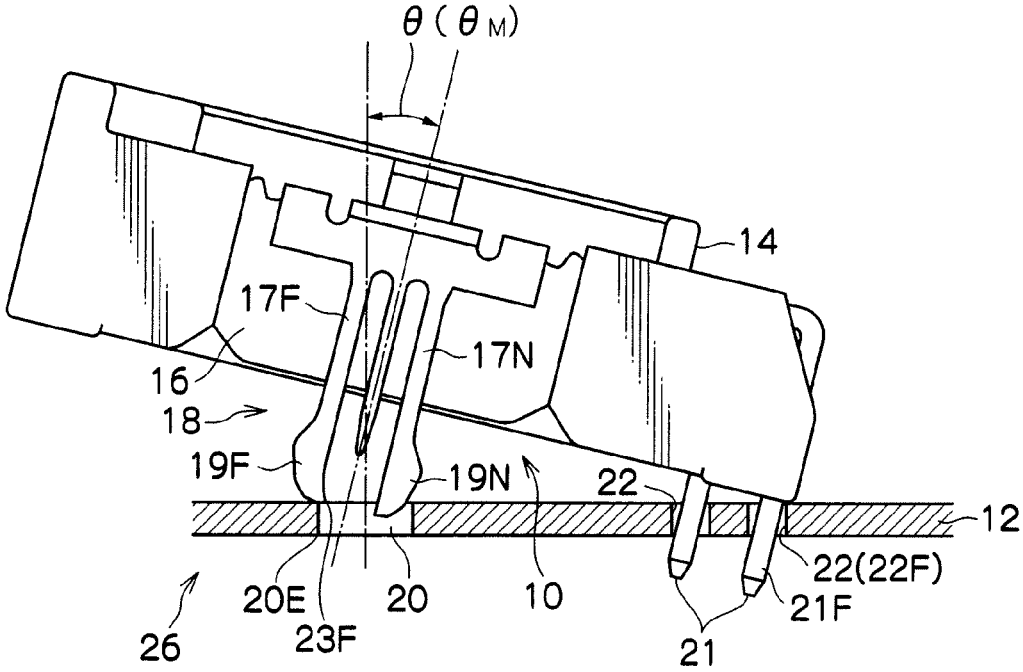
FIG. 1 is a side sectional view showing insertion of an electronic component mounted to a fixing member into a printed circuit board in a state in which tip ends of lug portions of the fixing member are in contact with an edge of an opening in the printed circuit board, in a first embodiment.

Embodiments of the present invention will be described below. In the second and following embodiments, components similar to those described already will be provided with similar reference numerals description thereof omitted.

1. First Embodiment

First, the first embodiment will be described. As shown in FIG. 1, a fixing member 10 of the present embodiment is a member capable of being mounted to an electronic component 14 to be fixed to a printed circuit board 12.

The fixing member 10 includes a fixing member main body 16 and a male connector portion 18 extending out from the fixing member main body 16 and the male connector portion 18 is a through-hole type connector portion.

The male connector portion 18 has two arm portions 17F, 17N. The arm portions 17F, 17N are respectively provided at their tip end sides with lug portions 19F, 19N to be engaged with an opening edge 20E of an insertion opening 20 formed in the printed circuit board 12.

From a lower face side of the electronic component 14, a plurality of terminals 21 protrude. In the printed circuit board 12, a plurality of insertion holes 22 are formed, into which the respective terminals 21 are inserted. In the present embodiment, as shown in FIG. 1, an example in which two terminals 21 (or two rows of terminals) protrude will be described.

Figure 2:
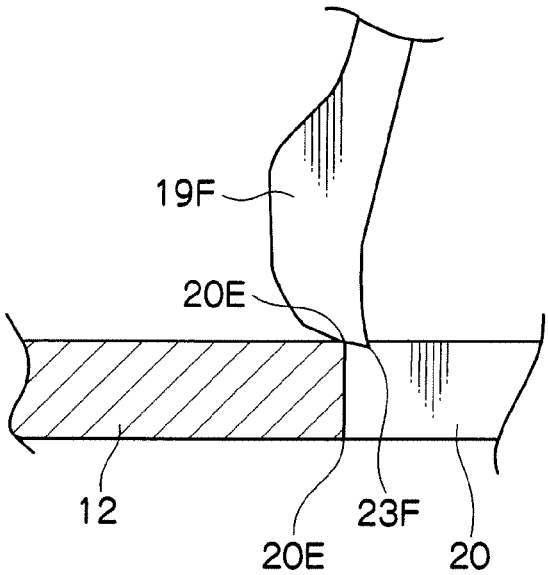
FIG. 2 is a partial enlarged view of the first embodiment shown in FIG. 1.

At a tip end portion of the lug portion 19F of the arm portion 17F that is farther from the terminals 21, a lug-guiding portion 23F extends out toward an inner side of the male connector portion 18. When the lug-guiding portion 23F is brought in contact with the opening edge 20E and pressed further, the lug portion 19F is guided to the insertion opening 20 (see FIGS. 1 and 2).

On the other hand, the lug portion 19N of the arm portion 17N that is closer to the terminals 21 is formed in a shape similar to a conventional shape.

In the present embodiment, the fixing member 10 is attached to the electronic component 14 and then, the terminals 21 of the electronic component 14 are inserted into the insertion holes 22 in the printed circuit board 12 and the male connector portion 18 is inserted into the insertion opening 20.

The dimensions of the lug-guiding portion 23F are determined in advance so that, as shown in FIG. 1, when the terminals 21 are first inserted into the insertion holes 22 to a maximum possible depth and the male connector portion 18 is then pressed toward the insertion opening 20, the lug portions 19 are inserted into the insertion opening 20 with the lug-guiding portion 23F coming in contact with the opening edge 20E. In the present embodiment, the maximum possible depth of insertion of the terminals 21 is defined as a depth at which the farther terminal 21F from the male connector portion 18 is inserted to its base (see FIG. 1). In the present embodiment, a side of the lug-guiding portion 23F closer to the opening edge 20E is formed in a curved protruding shape.

When setting the dimensions of the lug-guiding portion 23F as described above, the dimensions of the lug-guiding portion 23F are determined based on an inclination angle θM of the male connector portion 18 with respect to a direction normal to the insertion opening 20 when the terminal 21F is inserted into the insertion hole 22F to the maximum possible depth and also the lug portions 19 are in contact with the opening edge 20E. Thus, the appropriate dimensions of the lug-guiding portion 23F can be easily determined.

As described above, in the fixing member 10 of the present embodiment, the dimensions of the lug-guiding portion 23F are determined in advance so that, when the terminals 21 are first inserted into the insertion holes 22 to a maximum possible depth and the male connector portion 18 is then pressed toward the insertion opening 20, the lug-guiding portion 23F comes in contact with the opening edge 20E and the lug portions 19 are inserted into the insertion opening 20.

Accordingly, when forming a mounting structure 26 having the male connector portion 18 inserted into the insertion opening 20 in the printed circuit board 12 by pressing the electronic component 14 at which the fixing member 10 is mounted, the lug-guiding portion 23F can guide the lug portions 19 to the insertion opening 20 even when the inclination angle θ of the male connector portion 18 with respect to the direction normal to the insertion opening 20 is large. As a result, it is possible to considerably broaden the limit of the inclination angle θ as compared with the prior art. Therefore, even when the insertion is carried out in a state in which the tip ends of the lug portions 19 are in contact with the opening edge 20E, the electronic component 14 can be mounted on the printed circuit board 12. Consequently, the lug portions 19 formed on the male connector portion 18 of the fixing member can be easily inserted into the insertion opening 20 in the printed circuit board 12. In addition, when producing the mounting structure 26 the mounting operation is considerably easier, and the time of the mounting operation is considerably reduced, compared with the prior art.

2. Second Embodiment

Next, the second embodiment will be described. In place of the two arm portions 17F, 17N of the fixing member of the first embodiment, a fixing member of the present embodiment includes a male connector portion 38 provided with two arm portions 37F, 37N as shown in FIGS. 3A to 3C.

A lug portion 39F of the arm portion 37F that is farther from the terminals 21 (see FIG. 1) has a lug-guiding portion 43F formed by bending, and a lug portion 39N of the arm portion 37N that is closer to the terminals 21 also has a lug-guiding portion 43N formed by bending.

In the present embodiment, dimensions of the lug-guiding portions 43F, 43N are set in advance so that, when the terminals 21 are first inserted into the insertion holes 22 (see FIG. 1) to a maximum possible depth and the male connector portion 38 is then pressed toward the insertion opening 20, the lug-guiding portions 43F, 43N come in contact with the opening edge 20E and the lug portions 39F, 39N are inserted into the insertion opening 20.

Figure 3A:
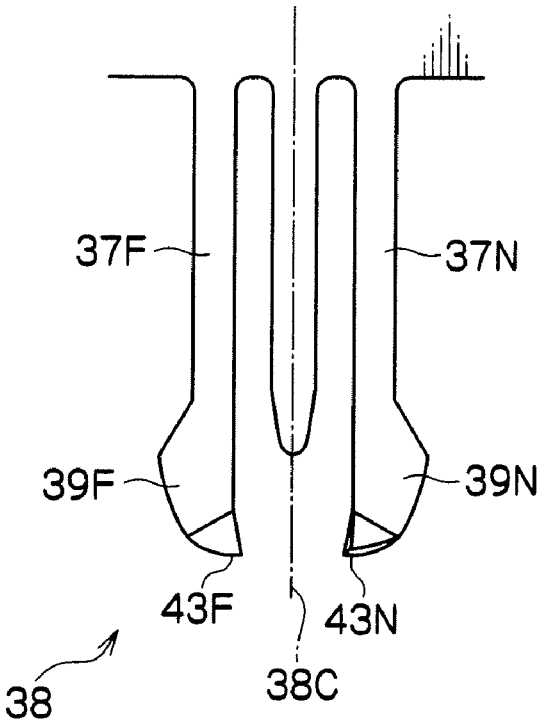
FIGS. 3A, 3B, and 3C are a front view, a bottom view, and a side view, respectively, showing a male connector portion of a fixing member of a second embodiment in a state in which the male connector portion is not inserted.
Figure 3C:
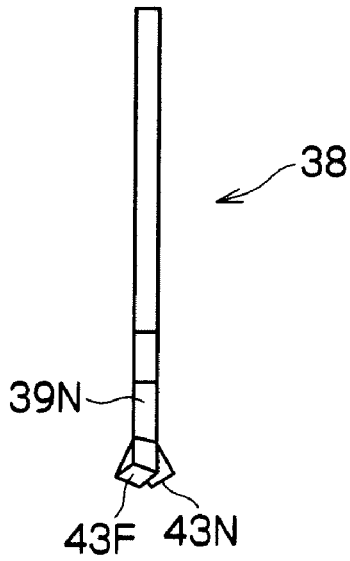
Figure 3B:
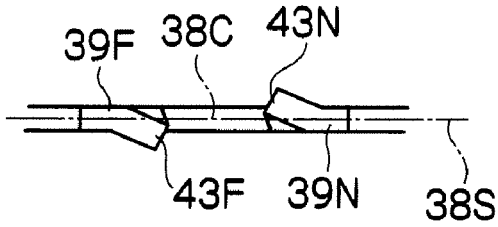

Further, in the present embodiment, as shown in FIGS. 3A to 3C, the shapes of the lug-guiding portions 43F and 43N are symmetric about a point on a center line 38C of the male connector portion 38 and the lug-guiding portions 43F and 43N do not interfere with each other when the two arm portions 37F, 37N are bent toward the inner side of the male connector portion 38, i.e., bent toward the center line 38C of the male connector portion 38. Thus, bending of the arm portions 37 is not obstructed by the lug-guiding portions 43 (see FIGS. 4A to 4C).

In addition, in the present embodiment, central faces of the arm portions 37F, 37N except the lug-guiding portions 43F, 43N are positioned in the same plane 38S that includes the center line 38C of the male connector portion. Therefore, as shown in FIG. 4, when the male connector portion 38 is inserted into the insertion opening 20, corner portions 40F1, 40F2 of an outer side of the lug portion 39F which are symmetric about the plane 38S come in contact with the opening edge 20E and receive a bending force. What is mentioned above can be applied to the lug portion 39N.

Figure 4A:
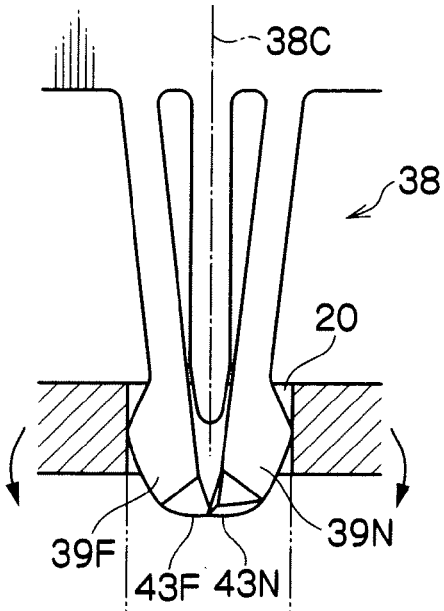
FIGS. 4A, 4B, and 4C are a front view, a bottom view, and a side view, respectively, showing the male connector portion of the fixing member of the second embodiment during insertion.
Figure 4C:
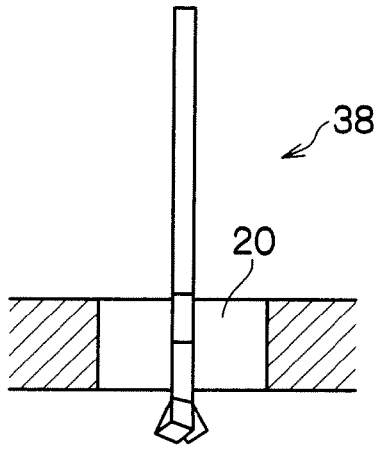
Figure 4B:
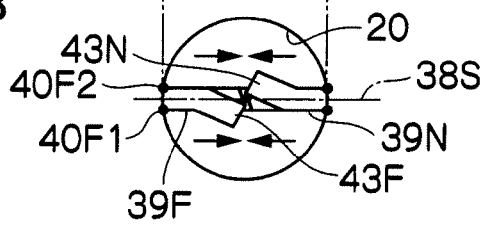

Therefore, when inserting the male connector portion 38 into the insertion opening 20, the arm portions 37F, 37N are bent without twisting (see FIGS. 4A to 4C). Accordingly, the force required for insertion of the male connector portion 38 and the retaining force thereof can be easily predicted and controlled.

Figure 5A:
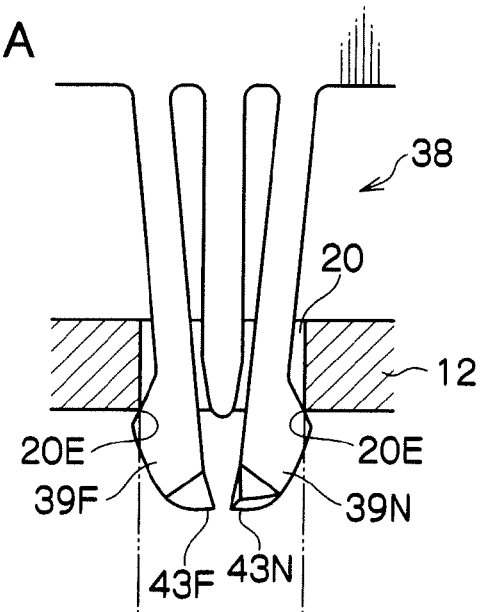
FIGS. 5A, 5B, and 5C are a front view, a bottom view, and a side view, respectively, showing the male connector portion of the fixing member of the second embodiment after completion of insertion.
Figure 5C:
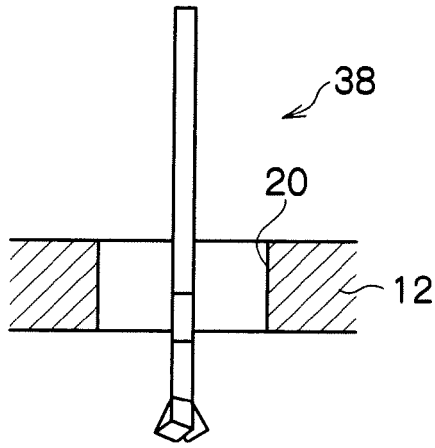
Figure 5B:
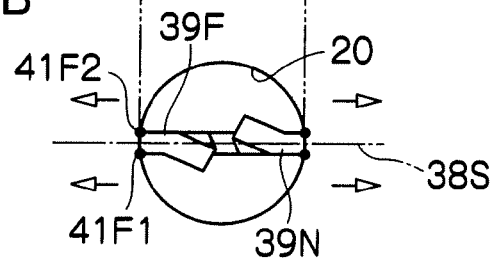

Furthermore, as shown in FIGS. 5A to 5C, when the lug portion 39F has passed through the insertion opening 20, edge portions 41F1, 41F2 of the outer side of the lug portion 39F which are on opposite sides of the plane 38S come in contact with the opening edge 20E and receive a reaction force due to a returning force of the arm portion 37F. What is mentioned above can be applied to the lug portion 39N.

Accordingly, fixing is carried out with the portions of the arm portions 37F, 37N other than the lug-guiding portions 43F, 43N, i.e., the portions thereof that are not bent, and the lug portions 39F, 39N receive only reaction forces that are in the same directions as the bending of the arm portions 37F, 37N. Therefore, it is easy to predict the reaction forces received by the arm portions 37F, 37N and residual stress in the arm portions 37F, 37N and, thus, in the present embodiment the dimensions and strength of the arm portions 37 can be preferably determined.

3. Third Embodiment

Next, the third embodiment will be described. In place of the two arm portions 17F, 17N of the first embodiment, a fixing member of the present embodiment includes a male connector portion 58 comprising two arm portions 57F, 57N as shown in FIGS. 6A to 6C.

A lug portion 59F of the arm portion 57F farther from the terminals 21 (see FIG. 1) has a lug-guiding portion 63F and a lug portion 59N of the arm portion 57N that is closer to the terminals 21 also has a lug-guiding portion 63N.

In the present embodiment, the dimensions of the lug-guiding portions 63F, 63N are also set in advance so that, when the terminals 21 are first inserted into the insertion holes 22 (see FIG. 1) to a maximum possible depth and the male connector portion 58 is then pressed toward the insertion opening 20, the lug-guiding portions 63F, 63N come in contact with the opening edge 20E and the lug portions 59F, 59N are respectively inserted into the insertion opening 20.

Figure 6A:
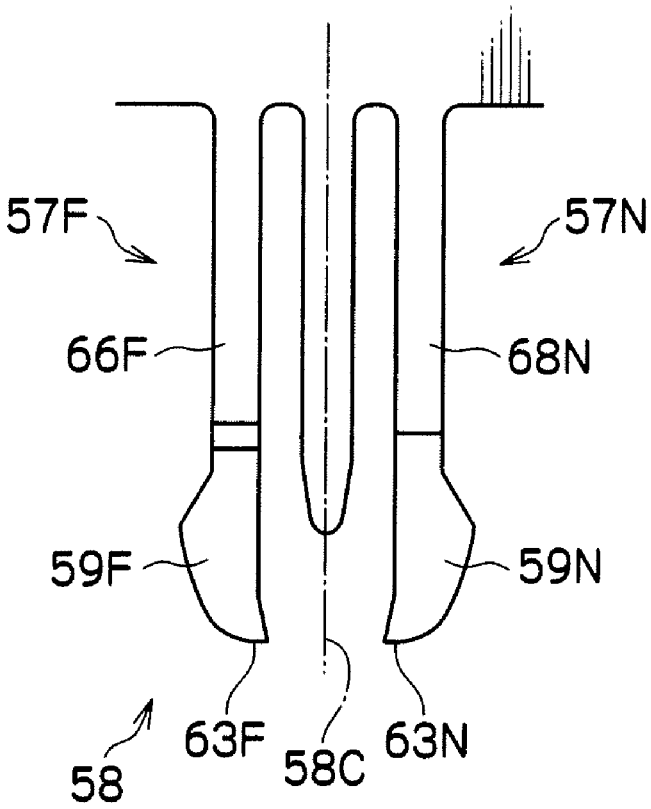
FIGS. 6A, 6B, and 6C are a front view, a bottom view, and a side view, respectively, showing a male connector portion of a fixing member of a third embodiment in a state in which the male connector portion is not inserted.
Figure 6C:
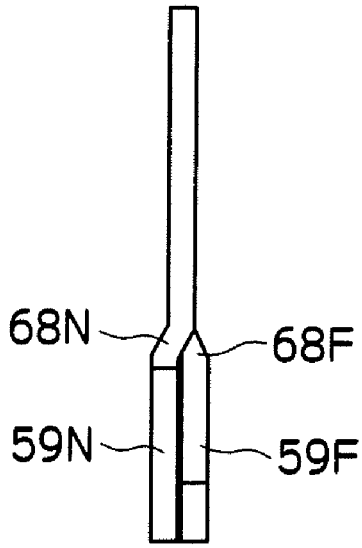
Figure 6B:
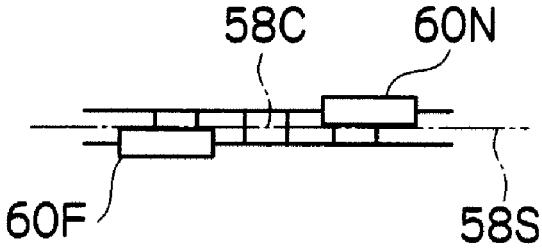

Furthermore, in the present embodiment, as shown in FIGS. 6A to 6C, the shapes of the lug-guiding portions 63F and 63N are symmetric about a point on a center line 58C of the male connector portion and the lug-guiding portions 63F and 63N do not interfere with each other when the two arm portions 57F, 57N are bent toward the inner side of the male connector portion, i.e., bent toward the center line 58C of the male connector portion. Accordingly, bending of the arm portions 57 is not obstructed by the lug-guiding portions 63.

Moreover, in the present embodiment, central faces of the arm portions 57F, 57N other than the lug-guiding portions 63F, 63N are positioned in the same plane 58S passing through the center line 58C of the male connector portion. Therefore, as shown in FIGS. 7A to 7C, when the male connector portion 58 is inserted into the insertion opening 20, a corner portion 60F at which the lug-guiding portion 63F comes in contact with the opening edge 20E and a corner portion 60N at which the lug-guiding portion 63N comes in contact with the opening edge 20E are positioned above and below the plane 58S in FIG. 7B and are disposed in such positions as to be symmetric about the center line 58C of the male connector portion about a point.

Figure 7A:
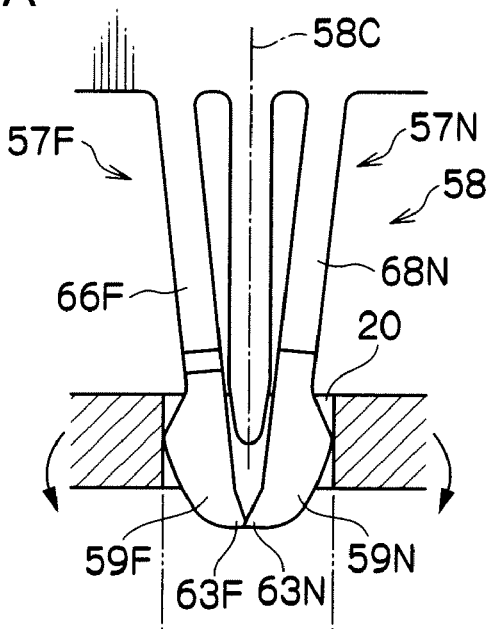
FIGS. 7A, 7B, and 7C are a front view, a bottom view, and a side view, respectively, showing the male connector portion of the fixing member of the third embodiment during insertion.
Figure 7B:
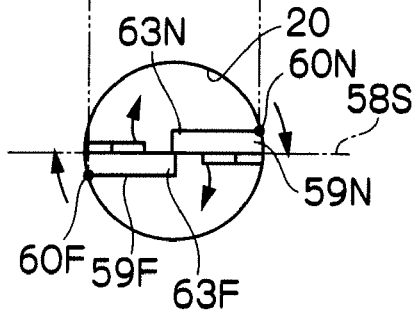
Figure 7C:
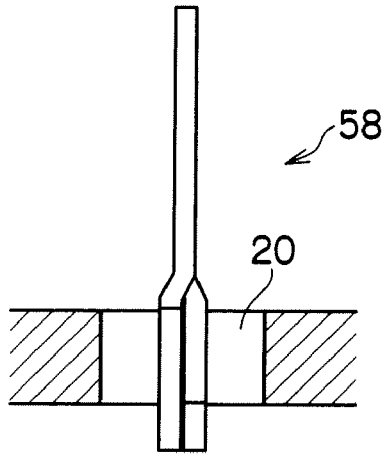

Therefore, in inserting the male connector portion 58 into the insertion opening 20, the arm portions 57F, 57N are bent without twisting (see FIGS. 7A to 7C). For this purpose, a rod portion 66F of the arm portion 57F, which is connected to the fixing member main body and to the lug portion 59F, has a bent portion 68F formed in the vicinity of a joint to the lug portion 59F. Similarly, a rod portion 66N of the arm portion 57N, which is connected to the fixing member main body 16 and to the lug portion 59N, has a bent portion 68N formed in the vicinity of a joint to the lug portion 59N.

Figure 8A:
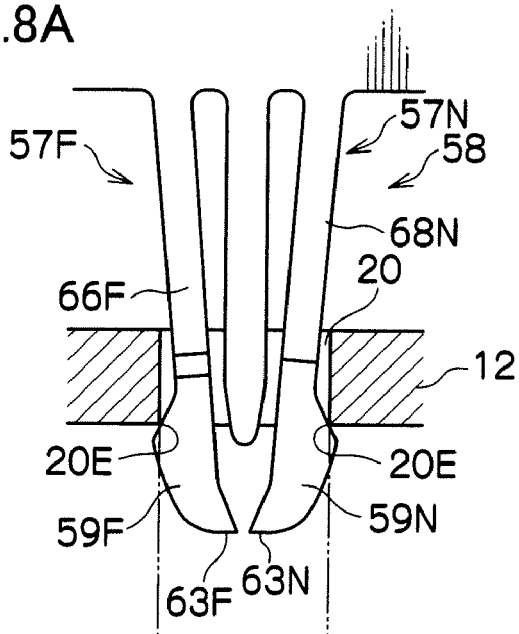
FIGS. 8A, 8B, and 8C are a front view, a rear[bottom?] view, and a side view, respectively, showing the male connector portion of the fixing member of the third embodiment completion of insertion.
Figure 8B:
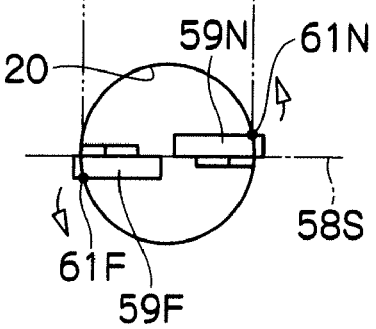
Figure 8C:
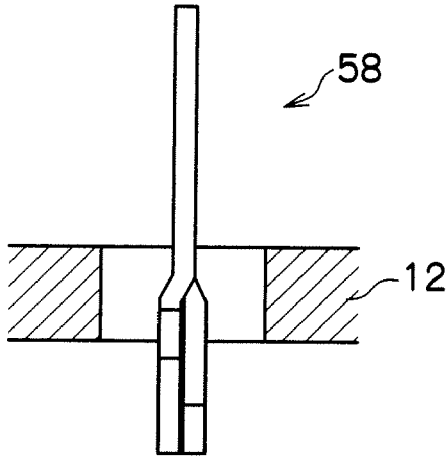
Figure 9:
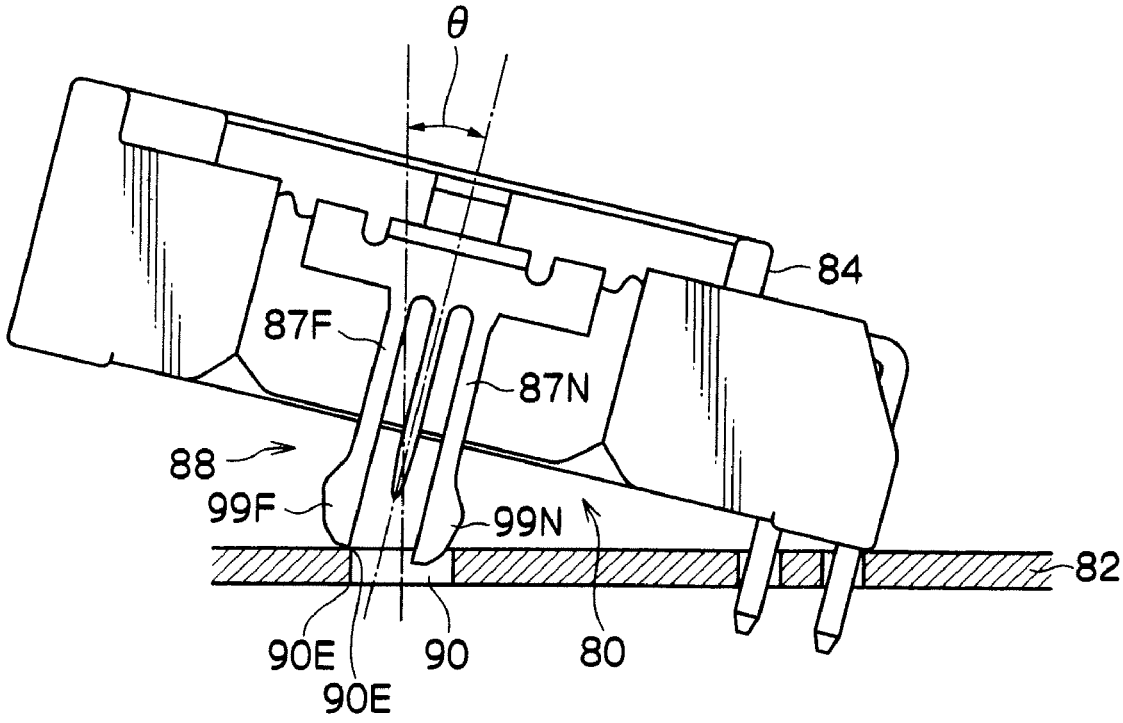
FIG.9 PRIOR ART
FIG. 9 is a side sectional view showing insertion of an example of a conventional fixing member into a printed circuit board in a state in which tip ends of lug portions of the fixing member are in contact with an edge of an opening in the printed circuit board.

Furthermore, as shown in FIGS. 8A to 8C, in the lug portions 59F, 59N which have passed through the insertion opening 20, edge portions 61F, 61N of the outer side of the lug portions 59 which are on opposite sides of the plane 58S respectively come in contact with the opening edge 20E and receive reaction forces due to returning forces of the arm portions 57F, 57N.

In the present embodiment, even though the lug portions 59F, 59N respectively come in contact with the opening edge 20E at one point and receive pressing forces as described above, bending of the arm portions 57 is not obstructed by the lug-guiding portions 63.

Although the embodiments of the present invention have been described, the above embodiments are examples and can be practiced while being altered in various ways within the scope of the invention without departing from the gist thereof. The scope of the rights of the invention is not limited to the above embodiments.

What is claimed is:

1. A fixing member that can be mounted to a fixed member that is fixed to a printed circuit board and that is used for fixing the fixed member to the printed circuit board, the fixing member comprising:

a male connector portion that is inserted into an insertion opening formed in the printed circuit board;

two arm portions provided at the male connector portion;

a lug portion provided at respective tip end portions of the arm portions that engages with an opening edge of the insertion opening; and lug-guiding portions extending out from the tip end portion of the lug portion of each of the two arm portions, that guide the lug portion through the insertion opening when the lug-guiding portions come into contact with the opening edge and are further pressed, wherein the lug-guiding portions are non-coplanar so as not to interfere with each other when the lug-guiding portions come in contact with the opening edge and guide the lug portions to the insertion opening.

2. The mounting structure of claim 1, wherein said lug portions overlap but do not mechanically interfere with one another during insertion through said opening.

3. The fixing member of claim 1, wherein two of the arm portions are provided and the lug-guiding portion extends out from the tip end portion of the lug portion of both of the arm portions.

4. A mounting structure comprising:

the fixing member according to claim 1;

a fixed member at which the fixing member is mounted and from which a terminal protrudes; and a printed circuit board having an insertion opening through which the male connector portion provided at the fixing member is inserted and an insertion hole through which the terminal of the fixed member is inserted, the fixed member being fixed by inserting the male connector portion through the insertion opening and by inserting the terminal through the insertion hole.

5. The mounting structure of claim 4, wherein dimensions of the lug-guiding portion of the fixing member are determined so that, when the male connector portion of the fixing member is pressed toward the insertion opening in the printed circuit board in a state in which the terminal of the fixed member is inserted into the insertion hole, the lug-guiding portion comes into contact with the opening edge and the lug portion is inserted into the insertion opening.

6. The fixing member of claim 3, wherein the lug-guiding portions overlap when said lug portions are inserted through the insertion opening but are formed so as not to interfere with each other.

7. The mounting structure of claim 6, wherein said lug portions are substantially flat and coplanar, and said lug-guiding portions are bent away from one another such that they are not coplanar to avoid mechanical interference during insertion of said lug portions through said insertion opening.

8. The mounting structure of claim 5, wherein the dimensions of the lug-guiding portion in the fixing member are determined based on an inclination angle of the male connector portion with respect to a direction normal to the insertion opening in the printed circuit board when the terminal of the fixed member is inserted into the insertion hole and the lug portion is in contact with the opening edge of the insertion opening.

9. The mounting structure of claim 8, wherein said lug guiding portion wedgingly engages the opening edge of the insertion opening to guide the lug portion through the insertion opening even when the male connector portion is oriented at said inclination angle with respect to a direction normal to the insertion opening and said lug portions of other of said plurality of said arm portions are inserted into said insertion opening.

* * * * *